US006547358B1

(12) United States Patent
Tanaka et al.

(10) Patent No.: US 6,547,358 B1
(45) Date of Patent: Apr. 15, 2003

(54) INK JET PRINTING APPARATUS AND EJECTION DATA FORMING METHOD

(75) Inventors: Hideki Tanaka, Kanagawa (JP); Shinji Takagi, Kanagawa (JP); Hiroyuki Hyotani, Kanagawa (JP); Takehiko Kasamatsu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/982,778

(22) Filed: Oct. 22, 2001

(30) Foreign Application Priority Data

Oct. 24, 2000 (JP) ..... 2000-324531

(51) Int. Cl.[7] ..... B41J 2/205; B41J 2/015; B41J 2/17

(52) U.S. Cl. ..... 347/15; 347/21; 347/95

(58) Field of Search ..... 347/100, 95, 9, 347/15, 21

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,538,160 A | | 8/1985 | Uchiyama | |
| 4,558,333 A | | 12/1985 | Sugitani et al. | |
| 4,723,129 A | | 2/1988 | Endo et al. | |
| 4,740,796 A | | 4/1988 | Endo et al. | |
| 5,635,969 A | * | 6/1997 | Allen | 347/96 |
| 6,084,606 A | * | 7/2000 | Moriyama | 347/19 |
| 6,084,621 A | * | 7/2000 | Shioya | 347/101 |
| 6,095,644 A | | 8/2000 | Kasamatsu et al. | |

FOREIGN PATENT DOCUMENTS

| | | |
|---|---|---|
| EP | 0 534 634 | 3/1993 |
| JP | 58-128862 | 8/1983 |
| JP | 59-123670 | 7/1984 |
| JP | 59-138461 | 8/1984 |
| JP | 64-63185 | 3/1989 |
| JP | 5-202328 | 8/1993 |
| JP | 8-52867 | 2/1996 |

* cited by examiner

*Primary Examiner*—Thinh Nguyen
(74) *Attorney, Agent, or Firm*—Fitzpatrick, Cella, Harper & Scinto

(57) ABSTRACT

In an ink jet printer, formation time of processing for generating data for providing a treatment liquid for improving fixing or water resistance of an ink by insolubilizing or coagulating a color material in the ink is reduced. For this purpose, to perform HV conversion for raster data for image data related to printing, processing for temporarily storing image data and processing of rewriting the HV conversion result are performed in a same sequence. For example, a treatment liquid data formation register having the same structure as an HV conversion register is provided. This register is masked to a pattern according to a treatment liquid composition on a printing medium and is made corresponding to data bits of the HV conversion register. Print data accessed by the HV conversion register is located in relation to the access, thereby forming the treatment liquid data simultaneously.

20 Claims, 11 Drawing Sheets

INK JET PRINTING APPARATUS AND EJECTION DATA FORMING METHOD

This application is based on Patent application Ser. No. 2000-324531 filed Oct. 24, 2000 in Japan, the content of which is incorporated hereinto by reference.

BACKGROUND OF THE INVENTION

1. Field of the Invention

The present invention relates to an ink jet printing apparatus and a data processing method used for the same apparatus. Specifically, the present invention relates to an ink jet printing apparatus and a data processing method used for the apparatus, which, when an ink as a printing agent is ejected from a print head to form a print dot on a printing medium, in association with the operation, for example, before or after the operation, ejects a treatment liquid for insolubilizing or coagulating the color material such as a dyestuff or a pigment in the ink.

2. Description of the Prior Art

Heretofore, when performing printing on a printing medium such as plain paper using an ink jet printing method, there could occur a deterioration of print image quality due to an effect of blotting or the like of the ink. Further, there has also occurred a problem in that storage stability is not good because the print image is insufficient in water resistance.

With the aim of solving such problems, for example, Japanese Patent Application Laid-Open No. 58-128862 (1983) discloses a technology in which, before a print dot forming operation by ejection of ink as a printing agent for taking part in image formation, or after the print dot forming, a treatment liquid, which is also called a print improving liquid or a fixation improving liquid, or called processing liquid solely, having an effect of effectively fixing the ink is ejected to form a treatment liquid dot, so that these dots are overlapped on the printing medium. Further, Japanese Patent Application Laid-Open No. 64-63185 (1989) discloses a technology in which after a compound for insolubilizing a dyestuff in the ink is deposited to the printing medium, print ink is ejected to form a print dot. Still further, Japanese Patent Application Laid-Open No. 5-202328 (1993) discloses a method for ejecting a treatment liquid for fixing the print ink effectively to provide a water resistance prior to the print dot forming operation, a method for coating the treatment liquid onto the printing medium by a roller, and a method in which the print ink and the treatment liquid are mixed while they are being sprayed from sprayers to be deposited onto the printing medium so that water resistance and fixing of the print ink are improved.

However, all of the above prior art examples deposit the treatment liquid to all the forming positions of print dots on the printing medium, thereby consuming the treatment liquid in more than the necessary amount, and in particular in the case of color printing using multicolor inks, the prior art examples have a problem of color mixing due to an excessive amount of treatment liquid. Then, in Japanese Patent Application Laid-Open No. 8-52867 (1996), the present applicant proposed a technology capable of depositing the treatment liquid for improving the fixing and water resistance of the ink only in an appropriate amount to an optimum position so that the function of the treatment liquid could be fully provided.

However, presently, with increasing requirements for color prints or high-quality prints, the amount of data to be processed accordingly becomes large, and an increased printing speed is required; in view of efficiently forming the ejection data of the treatment liquid, the prior art still has problems to be solved.

SUMMARY OF THE INVENTION

It is therefore an object of the present invention to make the ejection data formation time of the appropriate treatment liquid nearly the same as the processing time when the data formation is not required, so that the printing speed can be increased.

In an aspect of the present invention, there is provided an ink jet printing apparatus using a print head on which ejection openings capable of forming print dots by ejecting inks on a printing medium are arranged, and a treatment liquid head on which ejection openings capable of forming treatment liquid dots by ejecting a treatment liquid for insolubilizing or coagulating a color material in the ink are arranged, the print head and the treatment liquid head being scanned relatively to the printing medium in a direction different from a direction of the arrangement, the apparatus comprising:

means for converting data continuing in a direction corresponding to the relative scanning as data for print dots to be formed on the printing medium into data in a direction corresponding to the arrangement direction of the ejection openings;

means for generating forming position information of the treatment liquid dots on the printing medium corresponding to the data for print dots; and control means for processing the data conversion by the converting means and the generation of the treatment liquid dot forming position information by the generating means in a same sequence.

In another aspect of the present invention, there is provided an ejection data forming method for an ink jet printing apparatus using a print head on which ejection openings capable of forming print dots by ejecting inks on a printing medium are arranged, and a treatment liquid head on which ejection openings capable of forming treatment liquid dots by ejecting a treatment liquid for insolubilizing or coagulating a color material in the ink are arranged, the print head and the treatment liquid head being scanned relatively to the printing medium in a direction different from a direction of the arrangement, the method comprising the steps of:

converting data continuing in a direction corresponding to the relative scanning as data for print dots to be formed on the printing medium into data in a direction corresponding to the arrangement direction of the ejection openings;

generating forming position information of the treatment liquid dots on the printing medium corresponding to the data for print dots; and controlling the data conversion by the converting step and the generation of the treatment liquid dot forming position information by the generating step to be processed in a same sequence.

In the apparatus or the ejection data forming method according to the present invention, the treatment liquid forming position information on the printing medium for ejecting the treatment liquid for insolubilizing or coagulating the color material in the ink, the respective print data is temporarily stored, for example, at the time of a conversion of raster data into column data (HV conversion). Treatment liquid forming-position processing is performed before rewriting of the HV conversion result, that is, the HV conversion processing and the treatment liquid forming position processing are carried out in the same processing, thereby providing high-speed processing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

In the present specification, "printing" (also referred to as "recording" in some occasions) means not only a condition of forming significant information such as characters and drawings, but also a condition of forming images, designs, patterns and the like on a printing medium generally or a condition of processing the printing medium, regardless of significance or insignificance or of being actualized in such a manner that a person can visually perceive the image.

Further, the term "printing medium" means not only paper used in a conventional printing apparatus but also anything capable of accepting inks, such as fabrics, plastic films, metal plates, glasses, ceramics, wood, and leathers, and in the following, will also be represented by the term "print paper".

The present invention will be described in detail with reference to the drawings. The following will describe an example in which the present invention is applied to a color ink jet printer.

(Apparatus structure)

Figure 1:
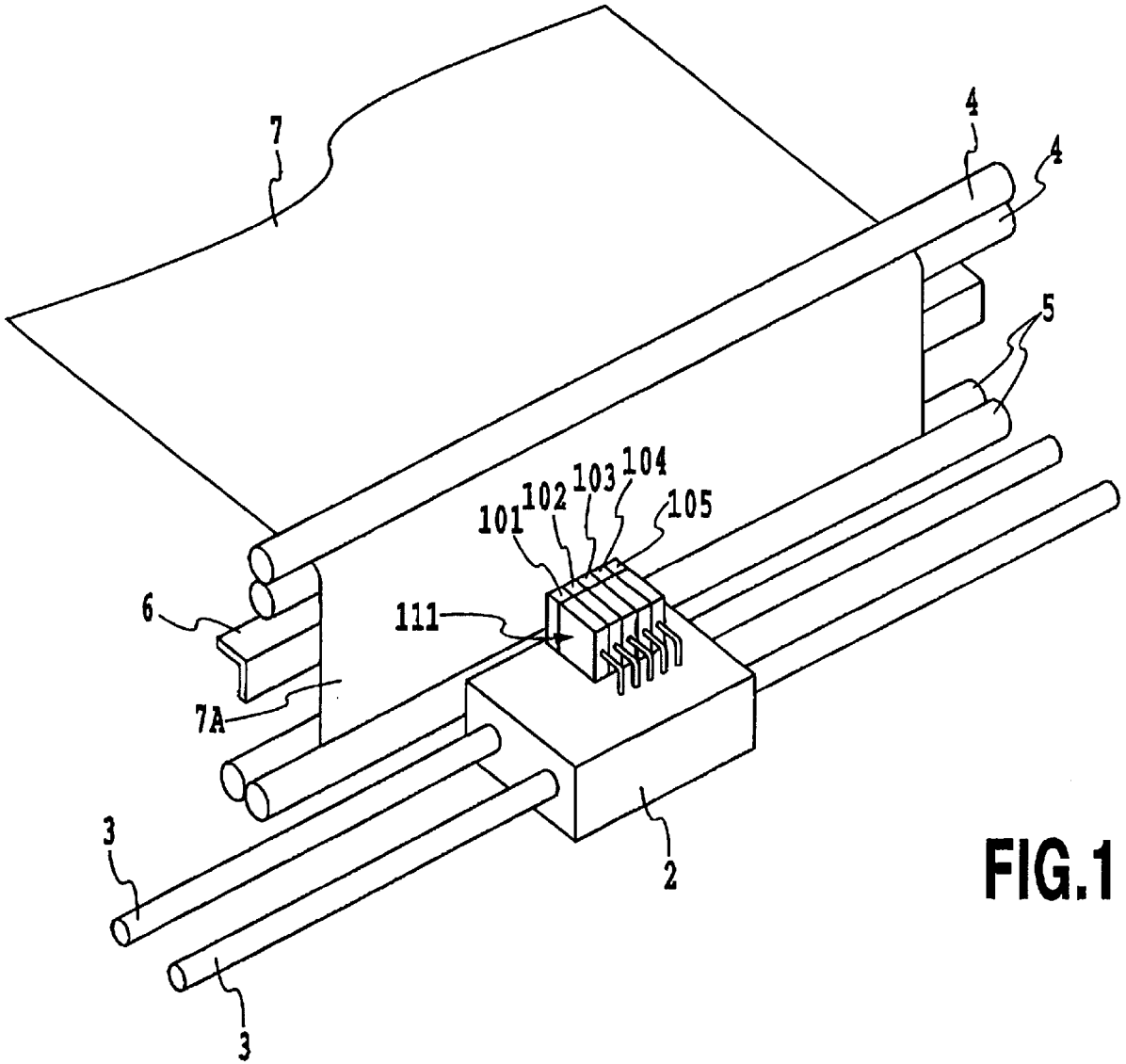
FIG. 1 is a schematic perspective view of a color ink jet printer to which the present invention can be applied.

FIG. 1 is a schematic perspective diagram of a color ink jet printer to which the present invention can be applied.

In FIG. 1, reference numeral 111 denotes a head section, which, as will be described later, is provided with print heads 101, 102, 103, 104 and a treatment liquid head 105. Each of these heads 101 to 105 has a plurality of ejection openings (for example, 64 ports) along a direction different from a scanning direction (a main scanning direction) during the printing operation, disposed on a surface opposing a printing medium 7 as a printing medium; each of the heads is caused to perform an ejection operation resulting from the transfer of corresponding print data serially to the print head, thereby performing a printing operation. Further, in the heads 101 to 105, a liquid passage for ink or a liquid passage for treatment liquid communicating with each of 64 ejection openings is provided, and an electrothermal transducer for generating thermal energy for ejecting the ink or the treatment liquid is formed on the structure substrate of the heads 101 to 105. The electrothermal transducer generates thermal energy by an electric pulse applied according to the print data, thereby generating film boiling in the ink or the treatment liquid, and in association with formation of a bubble by the film boiling, ejecting the ink or the treatment liquid from the ejection opening.

In each of the heads 101 to 105, each liquid passage is provided with a common liquid chamber communicating commonly with each liquid passage, and the ink or the treatment liquid stored in the chamber is supplied to each liquid passage according to an ejection operation from each liquid passage.

Each of the heads 101 to 105 may be in the form of a cartridge composed of a tank containing the ink or the treatment liquid and a head main body for ejecting the ink or the treatment liquid. Further, in the present embodiment, the print heads are provided in 4 units corresponding to yellow, magenta, cyan and black color inks; however, the kinds of color are not limited to these, and it is natural that a required number of units may be provided for necessary color tones (including colors and densities).

Further, as to the form of the head and the tank, both may be constructed in a completely integral form so that when the ink or treatment liquid in the tank is exhausted, it can be replaced together with the head cartridge, or both may be separably constructed so that only the tank can be removed and replaced. Alternatively, the head and the tank may be provided as separate components and the tank may be disposed at another position in the apparatus, and the head and the tank may be communicated by a tube or the like so that the ink or the treatment liquid is supplied to the head. In addition, rather than the head being provided for each ink color as shown in the figure, it can be formed as an integral printing unit having ejection sections capable of ejecting inks of a predetermined plurality of color tones.

In FIG. 1, the head section 111 is mounted on a carriage 2, and the carriage 2 is slidably engaged with a pair of guide rails 3 extending in parallel to a surface 7A to be printed of a printing medium 7. With this construction, the head section 111 can be moved in the right direction (main scanning direction) in the figure along the guide rails 3. In the process of this movement, the ink or the treatment liquid is ejected at a timing which will be described later to perform printing. After the completion of main scanning of the head section 111, the printing medium 7 is transported by a predetermined amount in the direction of the arrow, and then the printing operation is performed again. By repeating such operations, printing is performed successively to the printing medium 7.

Transportation of the printing medium 7 is achieved by rotation of a pair of transportation rollers 4 and 5 disposed at upper and lower sides of the printing surface 7A. Further, at the backside of the printing surface 7A of the printing medium 7, a platen 6 is disposed for maintaining the flatness of the printing surface 7A.

Movement of the carriage 2 becomes possible by driving of a belt (not shown) by a motor 2, and rotation of the transportation rollers 4 and 5 also becomes possible similarly by transmission of rotation of the motor to these rollers.

(Construction of control system)

Figure 2:
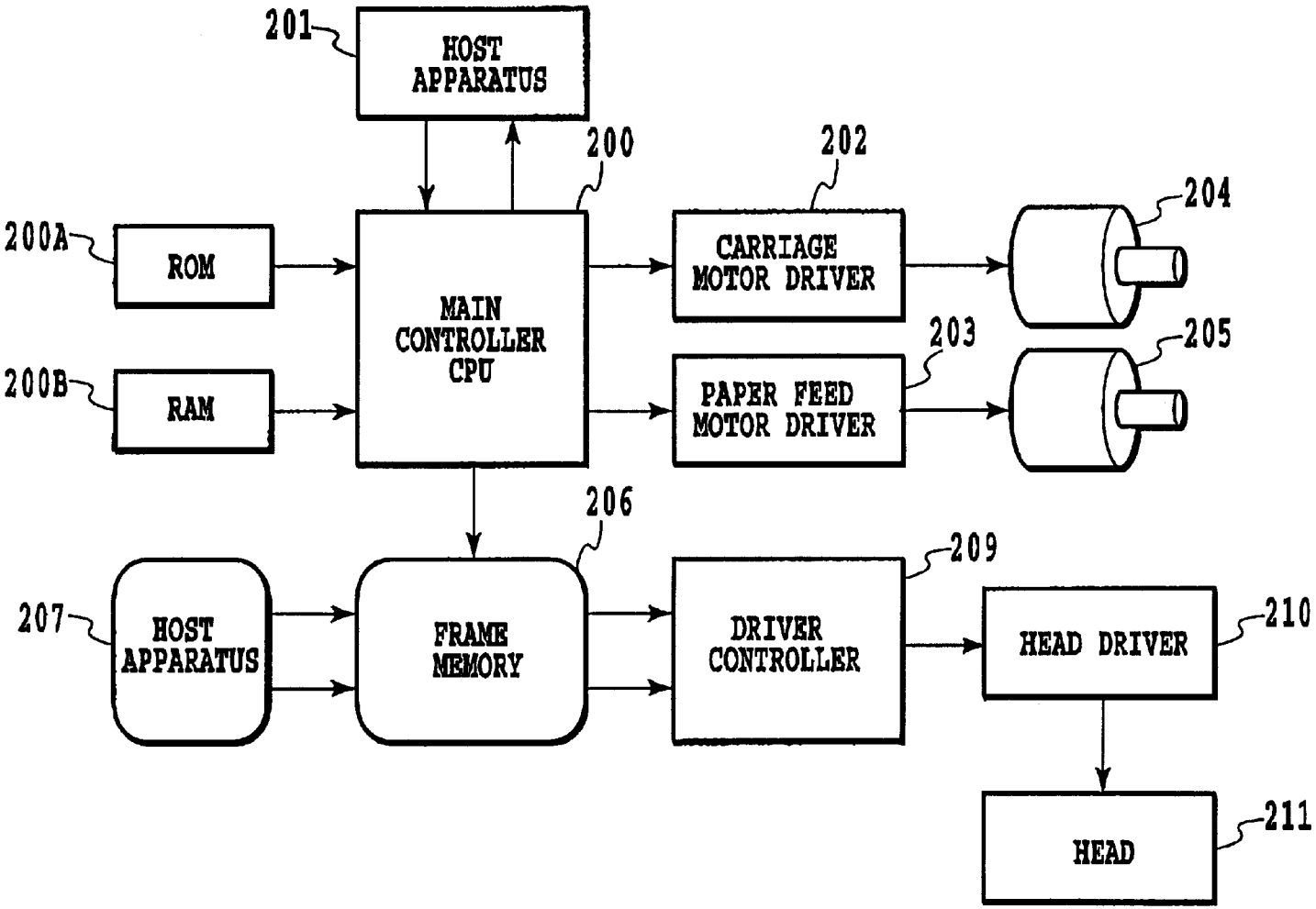
FIG. 2 is a block diagram showing the structure of a control system in the printer shown in FIG. 1.

FIG. 2 is a block diagram showing an example of a structure of a control system in the printer shown in FIG. 1.

In FIG. 2, a CPU 200 functions as a main controller for performing control processing for operating various components of the apparatus including control for forming treatment liquid dots which will be described later and data processing or the like. In a ROM 200A, the processing procedure or other fixed data and the like are stored, and a RAM 200B is used as a work area for executing the processing.

Ejection of the ink or treatment liquid from the head section 111 is performed by a process in which the CPU 200 supplies drive data and drive control signals of the electrothermal transducer according to the print data through a driver controller 209 towards the head driver 210. Further, the CPU 200 controls a carriage motor 204 for moving the carriage 2, and a paper feed (PF) motor 205 for rotating the transportation rollers 4 and 5 through motor drivers 202 and 203, respectively.

Here, a printing apparatus using a dot impact method, a thermal method, an ink jet method or the like equipped with a plurality of print elements as the print head often utilizes a method in which a printing operation is performed while the print head is moved in a direction perpendicular to the transportation direction of the printing medium as described above; at the stage when the printing operation of one line is completed, the printing medium is transported by the width of the print head and these operations are repeated to perform print processing (serial scan method). The image data to be printed in an amount of the print head width is transferred subsequently to the print head; every time of moving by a distance of one pixel, the print element is driven to form the image.

Since, in most cases, image data sent from a host apparatus (computer or image reading apparatus or the like) 201 as a supply source of image data to the printing apparatus is data continuing in the raster direction, data in the raster direction (horizontal direction) is converted into vertical direction data corresponding to a column direction (ejection opening arrangement direction or the like). Hereinafter, this conversion will be referred to as HV conversion.

In the past, as raster data conversion means, there have been a software method and a hardware method; either of these methods has used means for converting from the horizontal direction to the vertical direction bit by bit of the raster data.

One conversion means that is indicated by reference numeral 207 in FIG. 2 is a converter for performing such HV conversion by hardware, which has a structure in which the raster direction sequential data stored in a predetermined area in the frame memory 206 is read and HV converted and then rewritten in the frame memory 206.

(Prerequisite technology for treatment liquid ejection)

Next, a prerequisite technology for an ejection operation of the ink and treatment liquid will be described.

Figure 3:
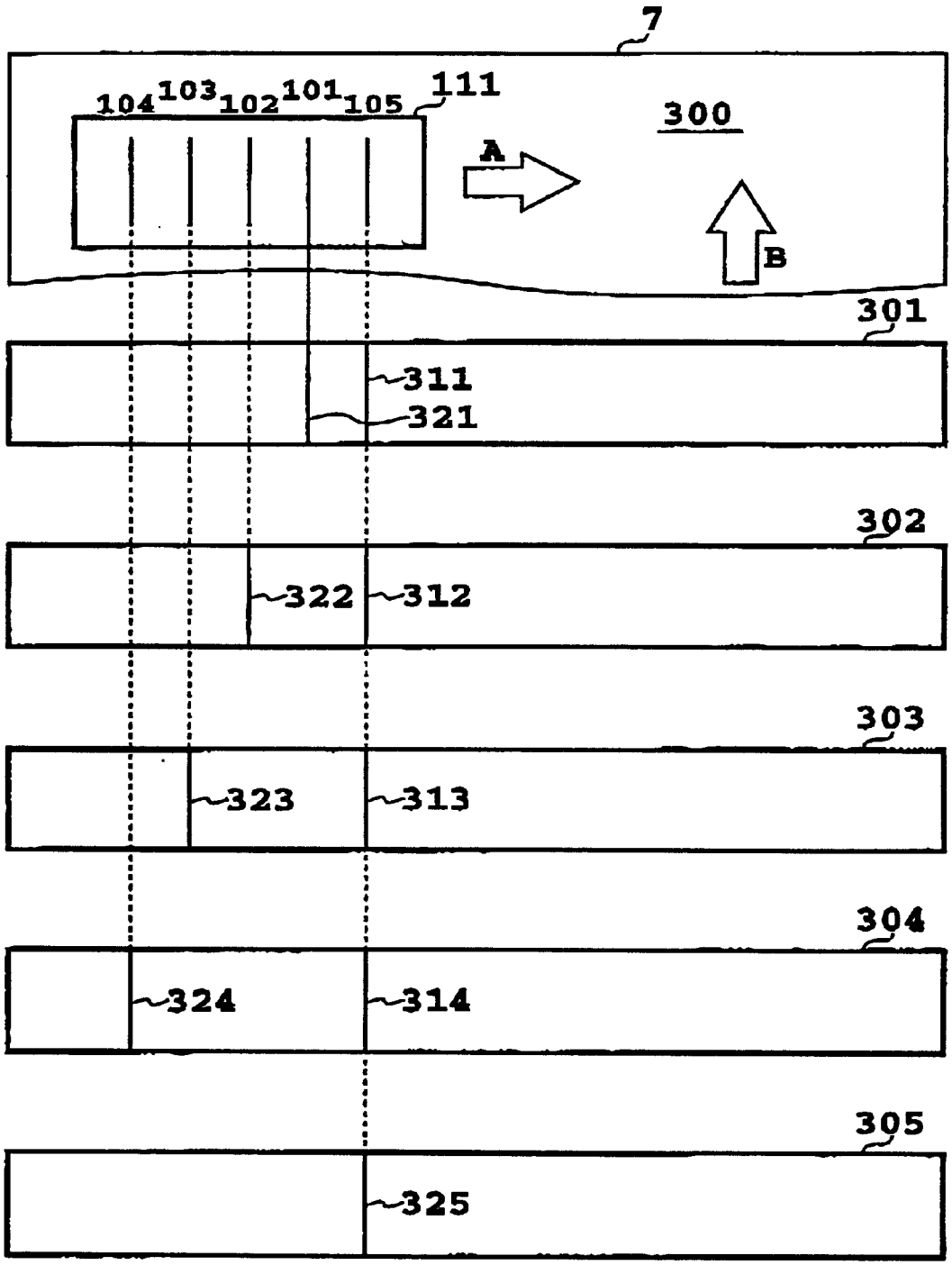
FIG. 3 is a diagram for explaining the relationship between the print head of FIG. 1 and the surface to be printed of the printing medium and the frame memory where the image data and the treatment liquid data to be printed are stored.

FIG. 3 shows the relationship between the head section 111 and the printing surface 300 of the printing medium and the frame memory storing data to be printed. Reference numeral 301 denotes a frame memory for storing data corresponding to the print head 101 for ejecting black (K) ink, 302 denotes a frame memory for storing data corresponding to the print head 102 for ejecting cyan (C) ink, 303 denotes a frame memory for storing data corresponding to the print head 103 for ejecting magenta (M) ink, and 304 denotes a frame memory for storing data corresponding to the print head 104 for ejecting yellow (Y) ink. Further, reference numeral 305 denotes a frame memory for storing data corresponding to the treatment liquid print head 105 for ejecting the treatment liquid for insolubilizing the dyestuff as a color material in the ink. Compositions of the ink and the treatment liquid will be described later. In the case of a single color printer, for example, the print head 101 for ejecting black ink may be provided with the treatment liquid head 105.

While ejecting ink of each color and the treatment liquid from the head section 111, the head section 111 is main-scanned in the direction of arrow A to print the image. In this example, the treatment liquid head 105 is disposed at the front side of the main scanning direction; after the treatment liquid is ejected from the head 105, inks of respective colors are ejected from the print heads 101, 102, 103, and 104. That is, after the treatment liquid is deposited on the printing surface 300 to form a treatment liquid dot, inks of respective colors are ejected to form print dots, thereby printing the image. Alternatively, it is also possible that after the print dot is formed, the treatment liquid is then ejected to form the treatment liquid dot.

In FIG. 3, the frame memories 301 to 305 are represented corresponding to the physical position over the printing surface 300, and the print data for the print head 101 stored in the frame memory 301, that is, black print data, is sequentially read in response to the movement of the head section 111 in the main scanning direction. Similarly, cyan, magenta, yellow and treatment liquid data stored in the frame memories 302 to 305 are also successively read in correspondence to the movement of the head section 111. That is, data 321, 322, 323, 324 and 325 corresponding to the shown position of the head section 111 opposing the printing surface 300 are read and transferred to the heads 101 to 105, thus performing the ejection operation.

Data corresponding to the treatment liquid head 105 is determined and stored in the frame memory 305, according to data of respective colors corresponding to the position of the treatment liquid head 105, that is, ejection data 311, 312, 313 and 314 in the frame memories 301, 302, 303 and 304, and to the treatment liquid composition.

Figure 4:
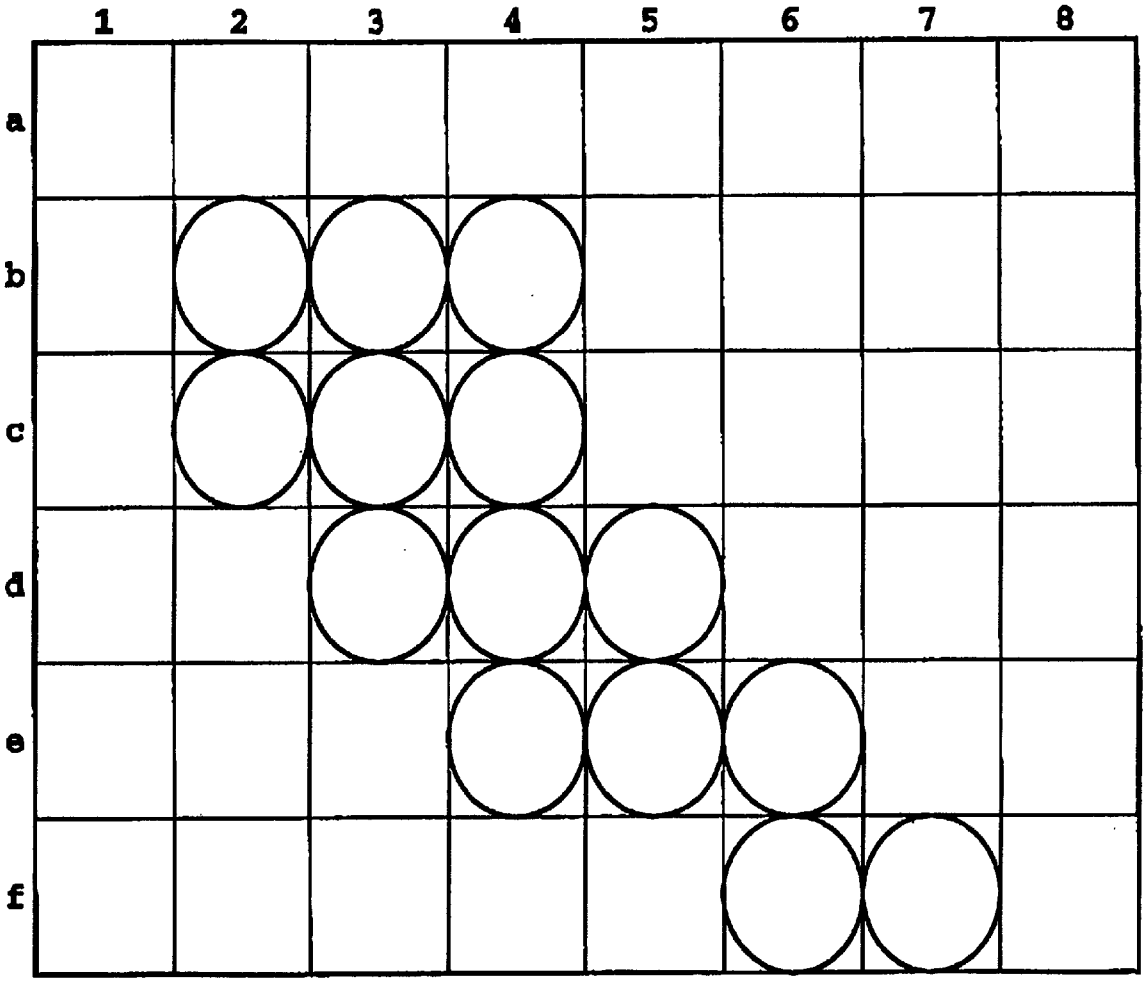
FIG. 4 is a diagram for explaining an example of data obtained by calculating the logical sum of print data corresponding to each of respective color inks.

Print data as shown in FIG. 4 are assumed. This data is obtained by calculating the logical sum of the print data corresponding to inks of respective colors. In FIG. 4, all ejection positions corresponding to this print data, that is, positions of print dots to be formed by these inks, are represented by white circles. The print dot is referred to as D1. Reference numerals 1 to 8 in FIG. 4 represent print positions in the main scanning direction A, and a to f show print positions in the paper feed direction B.

Figure 5:
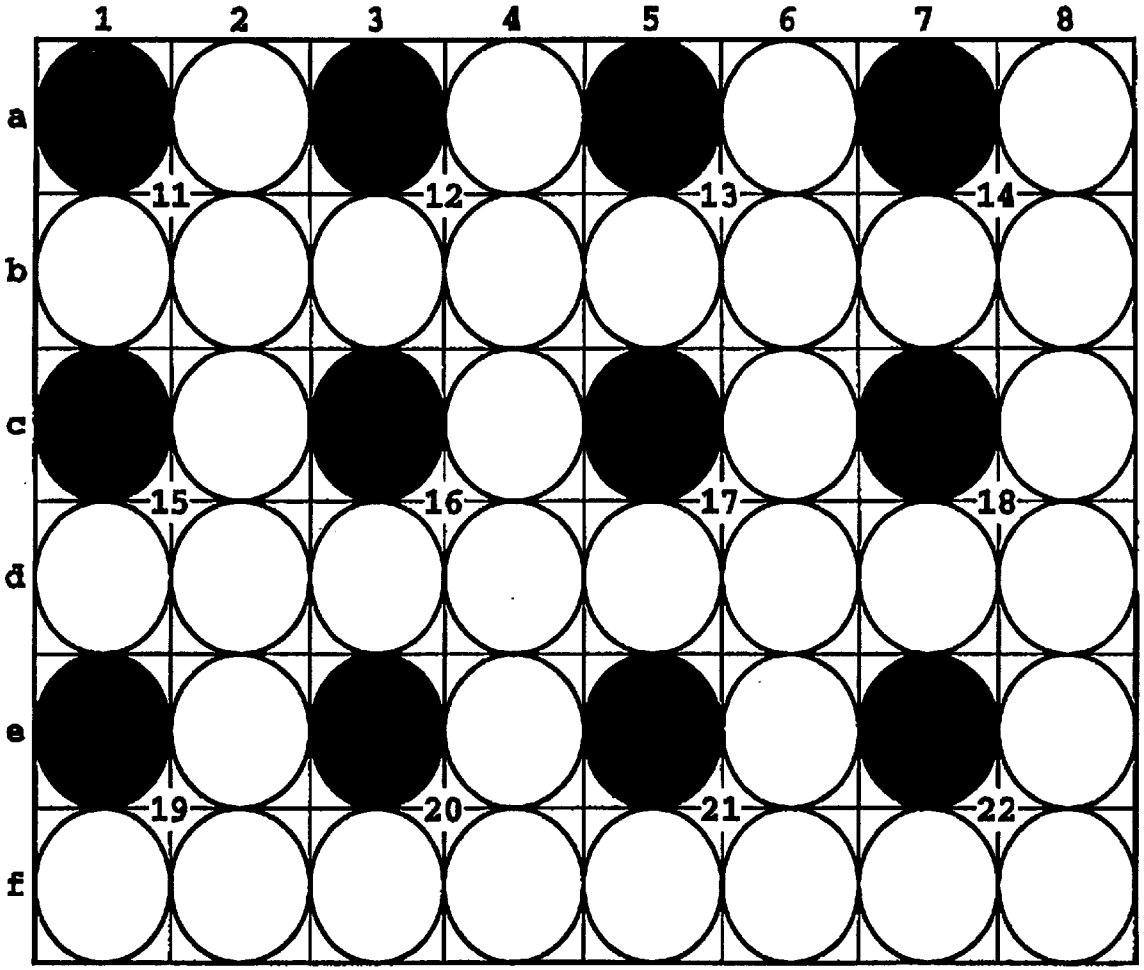
FIG. 5 is a diagram for explaining an example of judgment data for determining the deposition position of the treatment liquid corresponding to the print data.

FIG. 5 is a diagram for explaining the method for setting judgment areas denoted by reference numerals 11 to 22 in this figure. In this case, this judgment area is a small area corresponding to 2 dots×2 dots, when a print dot forming data is present in the position of a black circle in each small area, a treatment liquid dot (D2) is formed at that position on the printing surface, and then print dot D1 is formed. That is, treatment liquid data is formed by applying a mask pattern of 2 dots×2 dots to the print data. For example, for an area 16, since print dot forming data is present in coordinate (3, c) in FIG. 4, and a black circle is present at the corresponding position in the judgment area 16 in FIG. 5, the treatment liquid is ejected to the position shown by the black circle of area 16 to form treatment liquid dot D2.

That is, in the present example, the treatment liquid of about 25% is ejected according to the logical sum of print data corresponding to inks of respective colors of C, M, Y and K of the print image, and then print dots are formed. In the compositions of the treatment liquid and inks which will be described later, it has been determined by an experiment that this level of treatment liquid ejection amount is appropriate to obtain the above-described sufficient effect by the treatment liquid. In this embodiment, the treatment liquid ejection head 105 having the same structure as the other print heads 101 to 104 is used, and ejection amounts of respective nozzles are also the same.

Figure 6:
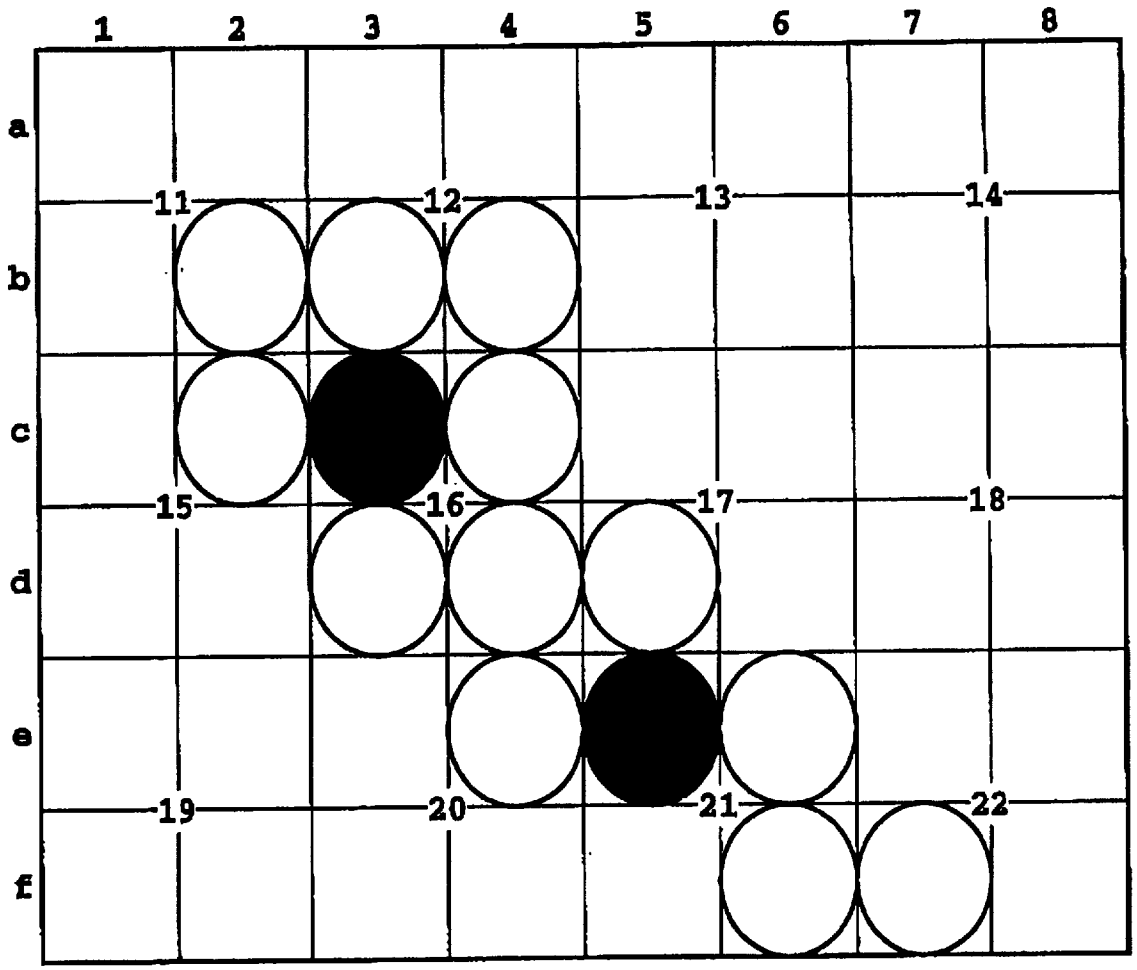
FIG. 6 is a diagram for explaining the treatment liquid deposition position obtained by applying the judgment data of FIG. 5 to the data of FIG. 4.

FIG. 6 is a diagram showing the position, shown by a black circle, of the treatment liquid dot actually formed on the printing medium. That is, in the frame memory 305 of FIG. 3, data corresponding to the black circle is stored which is obtained by calculating the logical sum (FIG. 4) of respective ejection data corresponding to respective color frame memories 301 to 304, and then judgment area masking is provided as shown in FIG. 5.

The judgment area is not limited only to one corresponding to 2 dots×2 dots, but may be selected according to the ejection amount of the treatment liquid head within the range that permits obtaining the effect of one treatment liquid dot.

Such a method has been proposed by the present applicant in Japanese Patent Application Laid-Open No. 8-52867 (1996) (Japanese Patent Application No. 6-188197 (1994)), in which a treatment liquid for improving fixation or water resistance of ink is deposited in an appropriate amount to an optimum position, to provide the function of the treatment liquid to a maximum, this is an effective technology. However, in the above method, since ejection data of the treatment liquid is formed before printing, for example, in color printing, processing such that respective data of black, cyan, magenta and yellow are all read and processed according to the treatment liquid composition, and treatment liquid data is newly stored in the memory, is required, before the printing operation becomes actually possible. Accordingly, in particular, in a case that the number of ejection openings is increased for performing high-resolution printing at a high speed and thereby, the print data amount to be processed is increased, in view of improved throughput of printing, more efficient treatment liquid ejection data formation is in demand.

Figure 7:
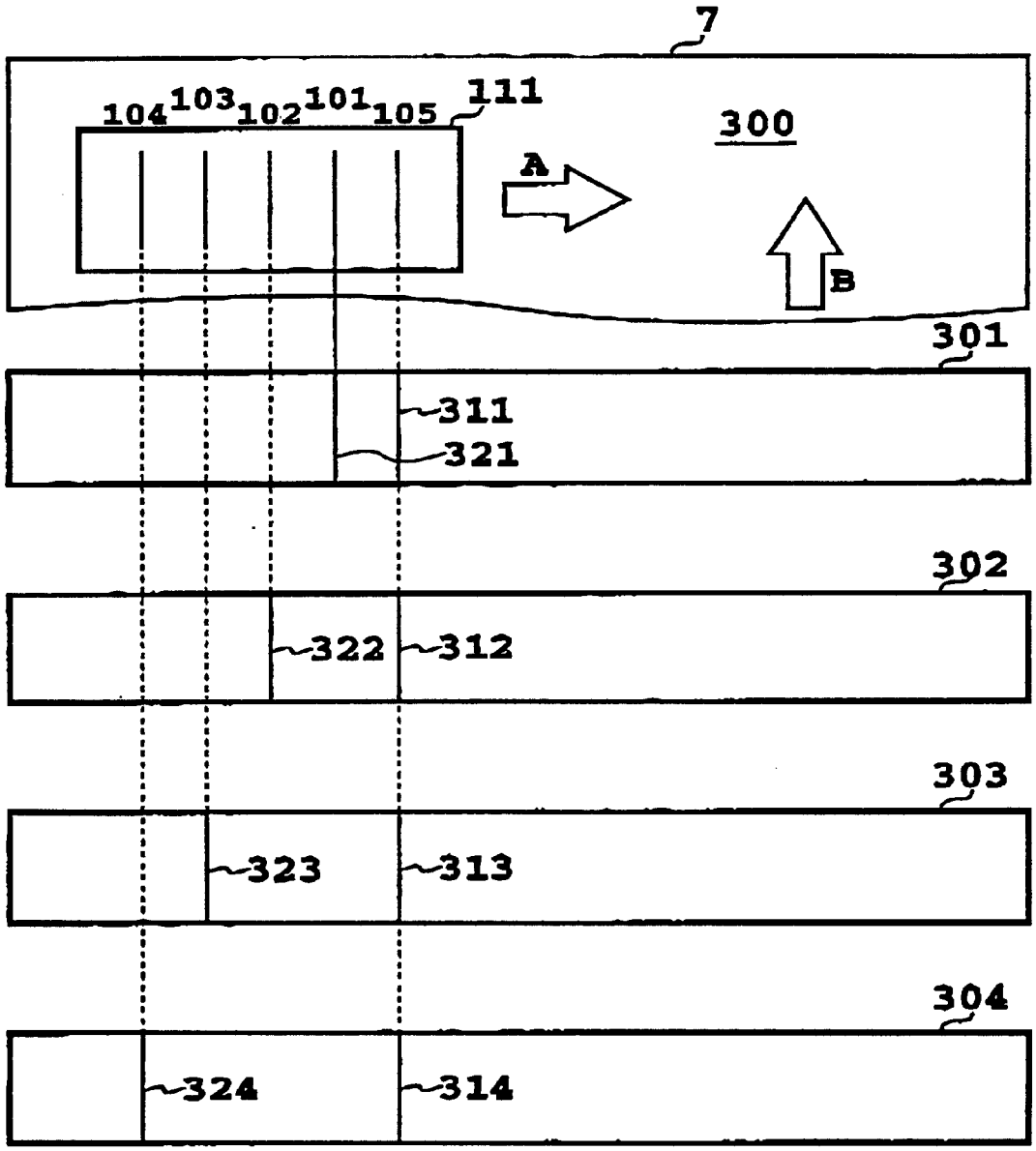
FIG. 7 is a diagram for explaining a method in which without securing memory area for treatment liquid ejection data, each color data is read from respective memory areas corresponding to the position of a treatment liquid head in synchronization with printing for performing treatment liquid data formation or treatment liquid ejection.

Further, as shown in FIG. 7, instead of newly securing a memory area for treatment liquid ejection data, a method may be adopted in which for forming treatment liquid ejection data in synchronization with printing and performing ejection, respective data of black, cyan, magenta and yellow are read from respective memory areas corresponding to the position of the treatment liquid head; after performing processing according to the composition of the treatment liquid, data transfer is performed to the treatment liquid head, thereby performing ejection. However, in the case of performing color printing in this example, data read requirements are generated 8 times (respective data 321 to 324 of black, cyan, magenta, and yellow, and for treatment liquid data formation, respective data 311 to 314 of black, cyan, magenta and yellow corresponding to the treatment liquid head positions).

Also in this method, under the circumstances of increasing the number of ejection openings for high-resolution and high-speed printing, when the scanning speed of the carriage is high, in view of time, it is very difficult to read data 8 times in synchronization with print timing, (Structure of HV conversion circuit)

Figure 8:
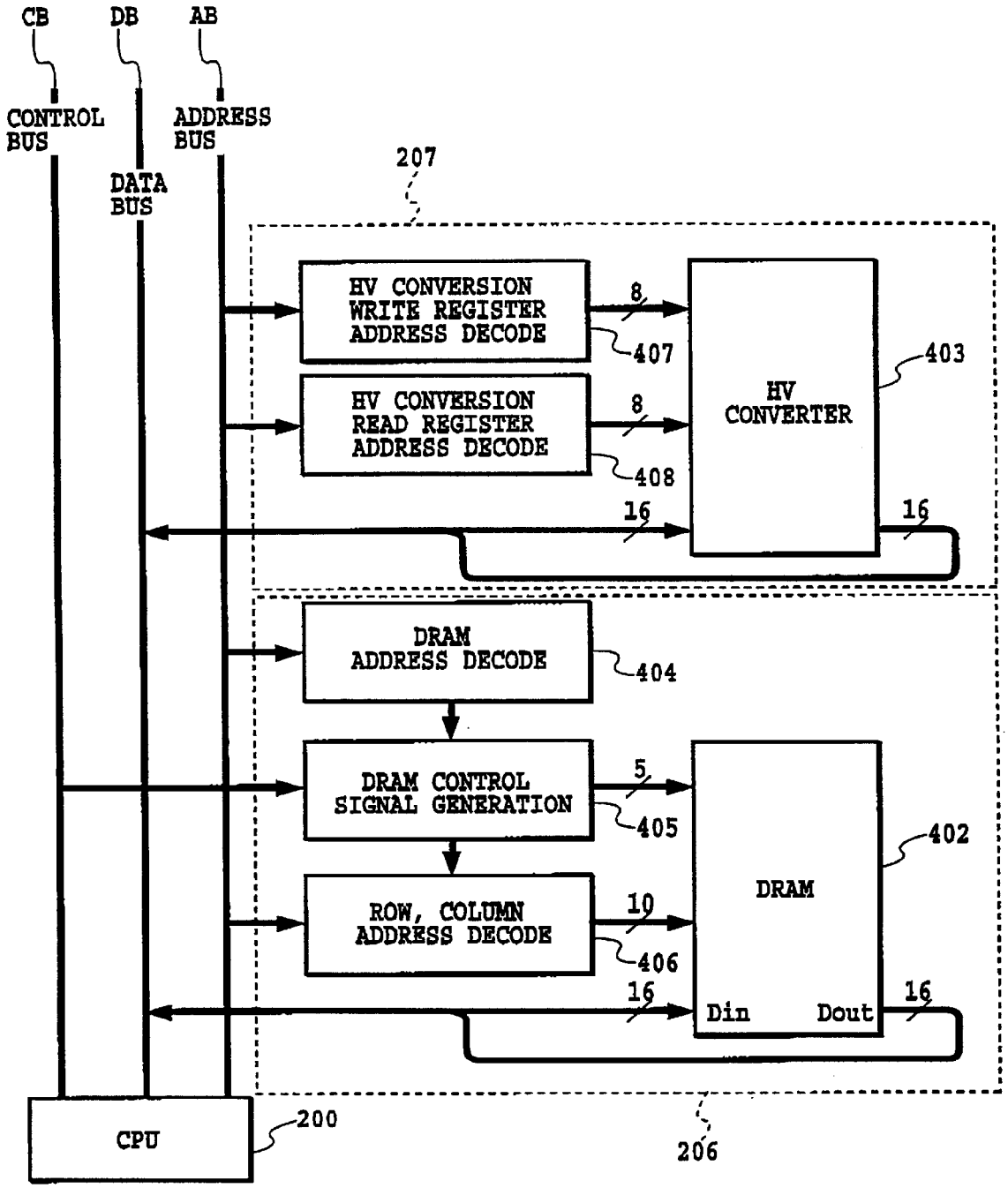
FIG. 8 is a block diagram showing an example of a detailed structure of an HV converter and a frame memory adopted in an embodiment of the present invention.

FIG. 8 is a block diagram showing an example of a detailed structure of an HV converter 207 and a frame memory section 206 adopted in the present embodiment for solving such problems, and the method of HV conversion in the present example will be described with reference to the figure.

A data bus DB of an external control signal line of microprocessor type CPU 200 is connected with a dynamic random access memory (DRAM) 402 for constituting a storage device, i.e., the frame memory section 206 having an area for storing raster data, areas corresponding to respective color frame memories 301 to 304, and an area corresponding to treatment liquid data frame memory 305, and with an HV converter 403 for constituting a main part of the HV converter 207.

For example, a memory of 8 M bits (512 K words×16 bits) may be used as the DRAM 402. In this case, the DRAM 402 is connected with an address bus AB of the CPU 200, while addresses from $X00000 to $XFFFF are allocated to the DRAM 402 ("$" means that the following numerical string is a hexadecimal number, and "X" denotes an appropriate number in hexadecimal numbers '0' to 'F'). To make the address $X00000 level into the address $D00000 level (X=D), a DRAM address decoding circuit 404 is constructed as a circuit for detecting a timing at which the upper 5 bits (A23 to A19) on the address bus are "11010B" (the last "B" shows that the foregoing numerical string is a binary number).

Next, a DRAM control signal generation circuit 405 for producing control signals for DRAM 402 (for example, row address strobe signal RAS*, column address strobe signal CAS*, OE*, upper address write enable signal UWE*, lower address write enable signal LWE*) from control signals from the CPU 200 (for example, system clock CLK, address strobe AS*, read/write signal RD/WR*) and the like upon receiving the detected timing signal is connected to a control bus CB. Further, a Row/Column address decoding circuit 406 for receiving switching timing of row (line direction) address and column (column direction) address from the DRAM control signal generation circuit 405 to convert the address on the CPU address bus AB into an internal address of the DRAM 402 is connected to the address bus AB of the CPU 200. Then, these are connected to the DRAM 402, and the CPU 200 accesses the DRAM 402 with a read-modify-write cycle.

On the other hand, by connecting the HV conversion write register address decoding circuit 407 and the HV conversion read register address decoding circuit 408 to the address bus AB, the HV converter 403 can be accessed by the CPU 200.

Figure 9:
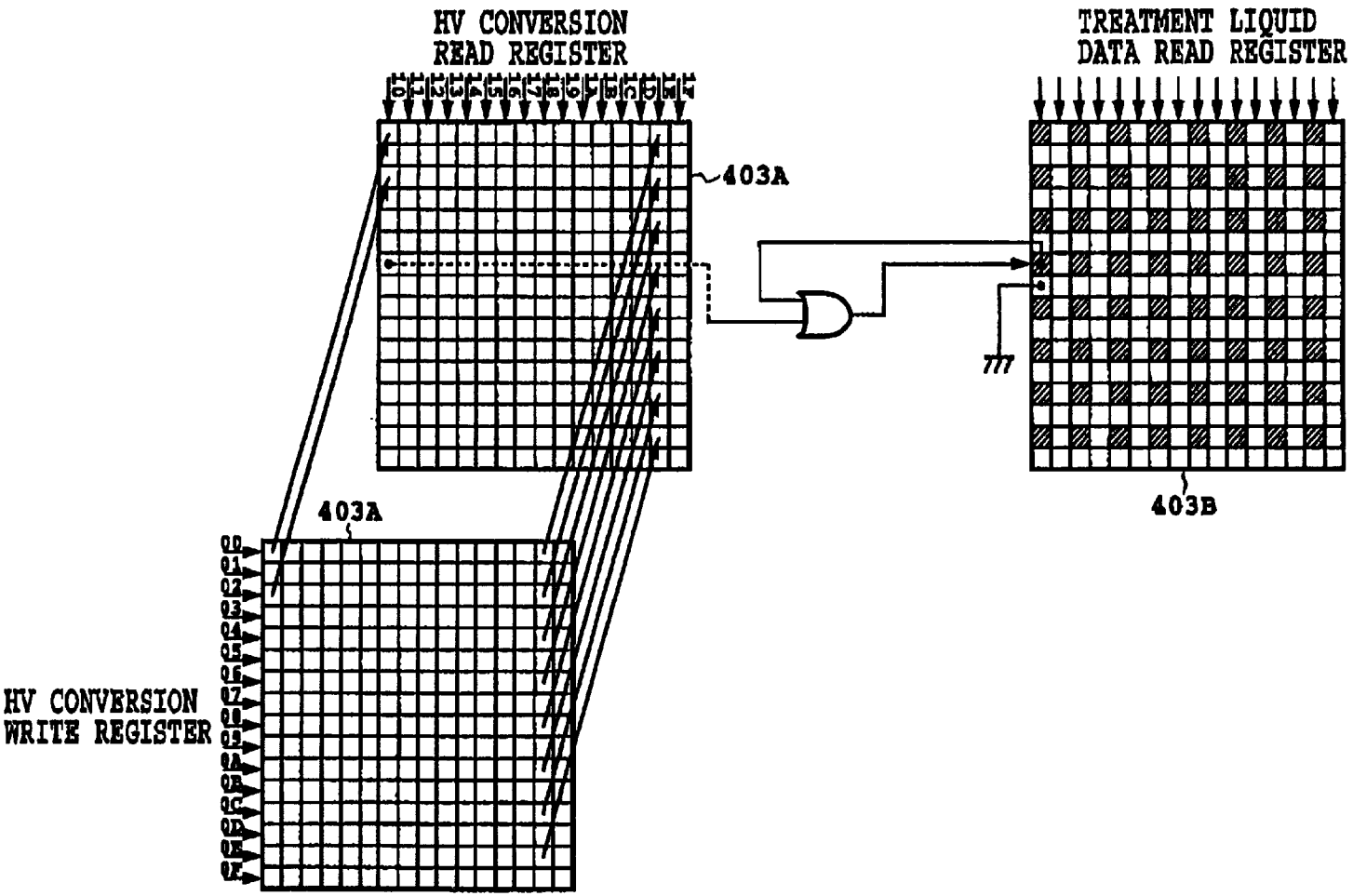
FIG. 9 is a diagram for explaining the structure and function of the HV converter in FIG. 8.

Here, when data of 16 bytes, including 16 areas each having 16 bits, designated by the HV conversion write register address (for example, addresses $FF0000 to $FF000F) are allocated as shown in FIG. 9, the HV conversion write register address decoding circuit 407 produces a signal for latching data on the data bus DB of the CPU 200 into the HV converter 403, in accordance with a timing signal generated when upper bits (A23 to A4) of address bus AB of the CPU 200 are 1111 1111 0000 0000 0000B and signal WE* showing writing operation by the CPU 200. Further, when data of 16 bytes including 16 areas each having 16 bits are allocated as shown in FIG. 9, the HV conversion read register address decoding circuit 408 produces a signal for outputting data stored in the HV converter to the data bus DB of the CPU 200, in accordance with a timing signal generated when the upper 20 bits (A23 to A4) of the address bus AB of the CPU 200 are "1111 1111 0000 0000 0001B" and a signal RD showing reading operation by the CPU 200.

Construction and function of the HV converter 403 will be described by referring to FIG. 9. The HV conversion register 403A constituting a main portion of the HV converter 403 comprises 16 latch circuits of respective 16-bit length.

During a writing operation, the addresses $FF0000 to $FF000F of the HV conversion register 403A are write-accessed, whereby the HV conversion register 403A functions as a HV conversion write register in performing HV conversion. That is, while incrementing the write address, when the CPU 200 performs the writing operation 16 times in a word unit (16 bits), data of 16×16=256 bits are held in HV conversion register 403A functioning as the HV conversion write register.

Next, when the CPU 200 reads data from the HV conversion register 403A, by read-accessing the addresses $FF0010 to $FF001F in the HV conversion register 403A, the HV conversion register 403A functions as an HV conversion read register for performing HV conversion. That is, from 256-bit data held by the writing operation, for example, when the address $FF0010 is read-accessed, a line of data held at the most significant position (the leftmost position) of each write register area is selected and outputted to the data bus of the CPU 200. Further, when the address $FF001F is read-accessed, a line of data held at the least significant position (rightmost position) of each write register area is selected and outputted to the data bus of the CPU 200.

As described above, data to be HV converted is first written by every 16 words into HV conversion register 403A, and then read by every 16 words from the HV conversion register 403A, thereby completing HV conversion.

When the above processing is performed in every 256 bits for respective colors in an amount necessary for printing a unit (for example, main scanning of one time), print data of respective colors are stored in DRAM 402 (respective color frame memories 301 to 304).

Further, the HV converter 403 is provided, separate from the HV conversion register 403A as print data locating means, with a treatment liquid data formation register 403B as treatment liquid data locating means having a similar structure. For each of data bits with hatching in the treatment liquid data formation register 403B and each of corresponding data bits in the HV conversion register 403A, the output lines thereof are connected to input ports of an OR gate, and OR output thereof is connected with the same bit in the treatment liquid data formation register 403B, while, for each of other data bits without hatching in the treatment liquid data formation register 403B, the input port thereof is connected to ground ("ground" in this case logically represents that the data is "0"). That is, the shown example has a structure capable of making masking similar to FIG. 5. Further, contents of the treatment liquid data formation register are set to "0" by a reset signal from the CPU 200.

Figure 10:
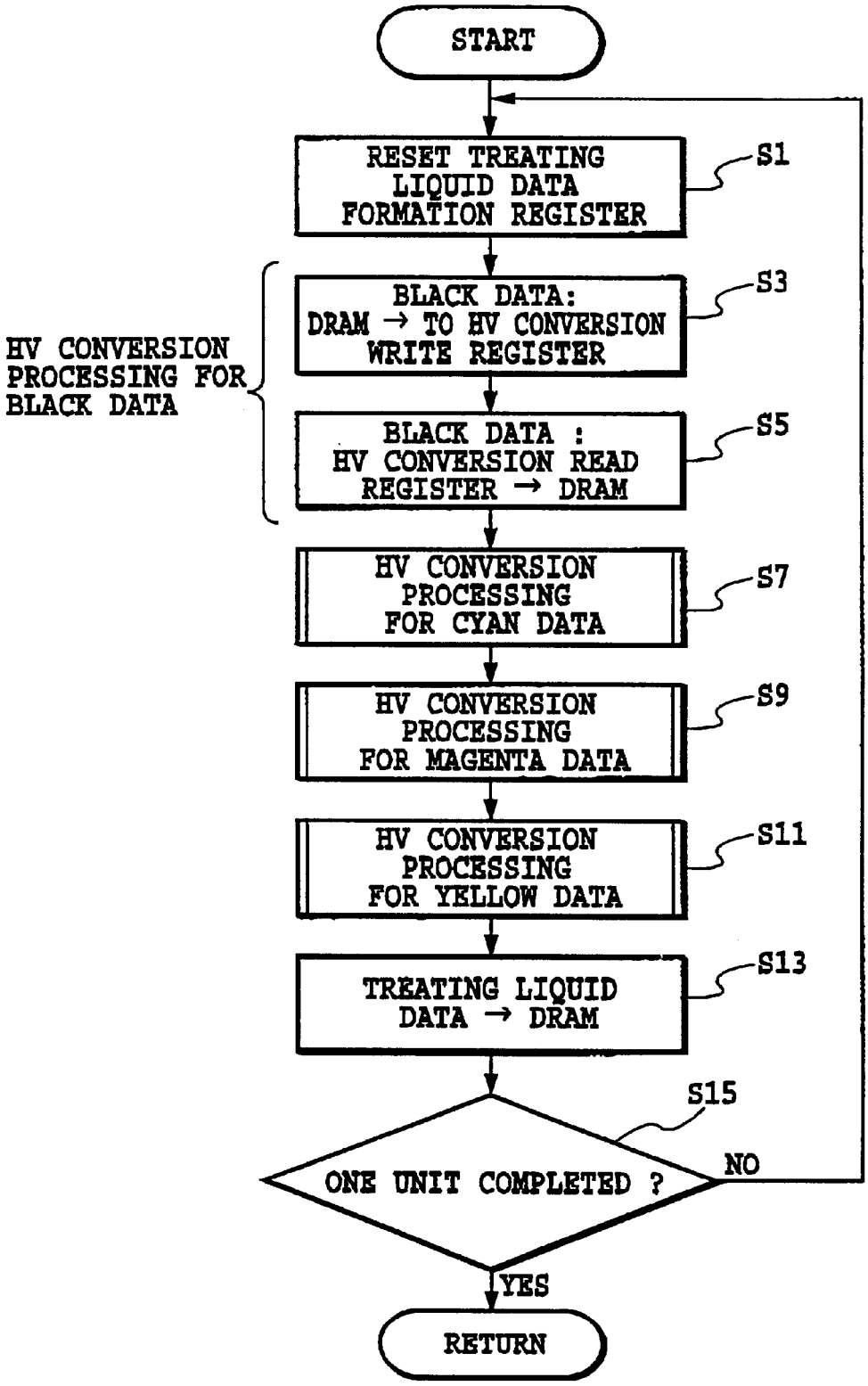
FIG. 10 is a flow chart showing examples of HV conversion of respective color data and treatment liquid data formation procedures by an embodiment of the present invention.

FIG. 10 shows an example of HV conversion of a respective color data and treatment liquid data formation procedure performed using the above structure. When this procedure is started, first, by a reset signal from the CPU 200, contents of the treatment liquid data formation register are all set to "0" (step S1).

Next, in order to perform HV processing for print data formation, first black data is read in a predetermined amount from a predetermined area (first storage means) of the DRAM 402 by the CPU 200 and written into the HV conversion write register (step S3). Then, the CPU 200 accesses the HV conversion read register to rewrite HV converted black data into a predetermined area (black frame memory 301 as second storage means) of the DRAM 402 (step S5). At this moment, since contents of the treatment liquid data formation register 403B have previously been set to "0", contents of respective bits shown by hatching of the data formation register 403B are quite the same as the contents of the corresponding bits of the HV conversion write register.

Data setting to the treatment liquid data formation register 403B may be performed such that the same write addresses as those of the HV conversion write register are allocated on the register 403B. whereby the same data is simultaneously sent to the register 403B at the time of data writing to the HV conversion write register. Alternatively, at the time of data reading from the HV read register or at the time of transfer to the DRAM 403, the data transfer may be performed also to the treatment liquid data formation register 403B.

Next, to perform HV conversion processing for cyan print data formation similarly (step S7), a predetermined amount of cyan data is read by the CPU 200 from a predetermined area of the DRAM 402 and written to the HV conversion write register. Then, the CPU 200 accesses the HV conversion read register to rewrite HV converted cyan data to a predetermined area (cyan frame memory 302 as second storage means) of the DRAM 402 (step S5) At this moment, contents of respective bits shown by hatching of the treatment liquid data formation register are those of the above black data ORed with the present cyan data Next, to perform HV conversion processing for magenta print data formation similarly (step S9), a predetermined amount of magenta data is read by the CPU 200 from a predetermined area of the DRAM 402 and written to the HV conversion write register Then, the CPU 200 accesses the HV conversion read register to rewrite HV converted magenta data to a predetermined area (magenta frame memory 303 as second storage means) of the DRAM 402. At this moment, contents of respective bits shown by hatching of the treatment liquid data formation register are those of the above logical sum data of black with cyan ORed with the present magenta data.

Next, to perform HV conversion processing for yellow print data formation similarly (step S11), a predetermined amount of yellow data is read by the CPU 200 from a predetermined area of the DRAM 402 and written to the HV conversion write register. Then, the CPU 200 accesses the HV conversion read register to rewrite HV converted yellow data to a predetermined area (yellow frame memory 304 as second storage means) of the DRAM 402. At this moment, contents of respective bits shown by hatching of the treatment liquid data formation register are those of the above logical sum data of black, cyan, and magenta ORed with the present yellow data.

When a series of processings for each color is completed, the CPU 200 reads treatment liquid data from the treatment liquid data formation register and writes it to a predetermined treatment liquid data area (treatment liquid frame memory 305 as third storage means) on the DRAM 402.

The above processing is repeatedly performed for a unit (for example, main scanning of one time) of data to be printed (step S15). By this operation, print data of one main scanning for respective colors are stored in the frame memories 301 to 304; data being the ORed data of respective colors provided with masking similar to that shown in FIG.

5 is stored as treatment liquid data in the treatment liquid data memory (frame memory 305).

When adopting the above-described structure and processing, the number of times of accessing the DRAM 402 or the frame memory 206 for preparing the treatment liquid, as to the reading operation, does not increase since the accessing is simultaneously done with those of respective colors during HV conversion. As to the write operation, the number is increased only by one time for the treatment liquid; accordingly, a substantial reduction of the total processing speed does not occur.

(Second example of HV converter)

Figure 11:
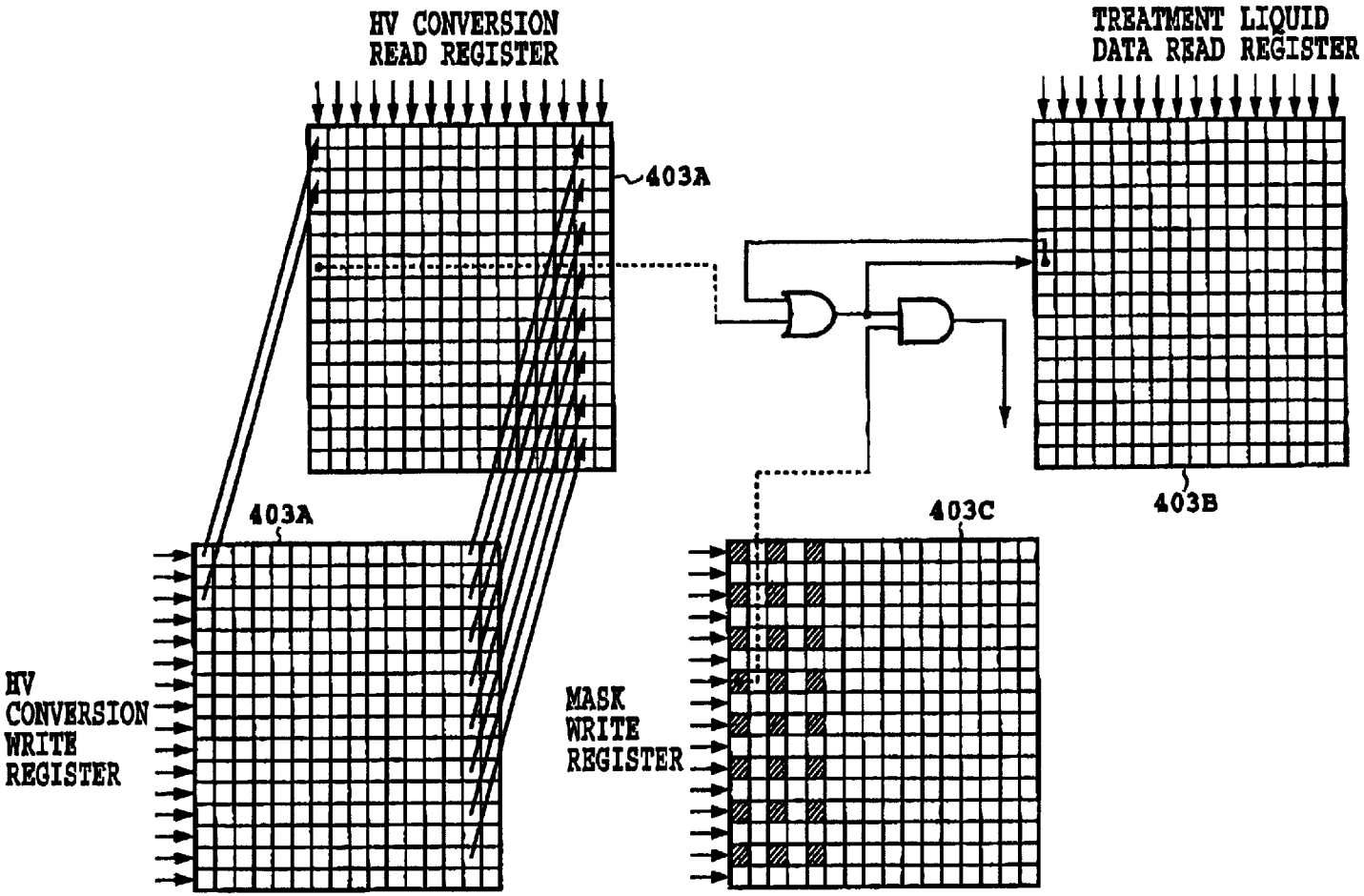
FIG. 11 is a diagram for explaining the structure and function of the HV converter according to another embodiment of the present invention.

FIG. 11 is a diagram showing a modification example of the HV converter 403. In the present embodiment, a mask register 403C is added to the construction of FIG. 9 of the above example. The mask register 403C is of 16×16 bit structure similar to the HV conversion register 403A and the treatment liquid formation register 403B. Further, the mask register may be a write-only register which is not read from the CPU.

Further, structure of a gate circuit related to the treatment liquid formation register 403B is different from the above example. That is, corresponding respective data bits of the HV conversion register 403A and the treatment liquid data formation register 403B are both connected to the input ports of an OR gate. Output of the OR gate is connected to the corresponding bit of the treatment liquid data formation register 403B, and to one input port of a 2-input AND gate. The other input port of the AND gate is connected with output from the corresponding bit of the mask register 403C; when the contents of the treatment liquid formation register are read by the CPU 200, the logical sum of corresponding bits of the mask register 403C with the treatment liquid formation register 403B is outputted.

In the above construction, the CPU 200, prior to processing, in order to determine a pixel on which the treatment liquid is to be deposited or ejected, sets mask data to the mask register 403C. Here, it is assumed that mask data "1" is set to the hatched part of the mask register 403C, and "0" to the unhatched part.

Thereafter, processing is performed similarly to the above embodiment. In this case, for the part where "1" is set to the mask data, ORed data of respective colors is read, as is, from the treatment liquid formation register; for the other part, the output is "0" even when data of the treatment liquid formation register is any value. That is, treatment liquid depositing position or treatment liquid dot forming position can be controlled by the mask data appropriately set by the CPU 200.

This is effective for the case when deposition amount or forming position of the treatment liquid is to be hanged according to the type of the printing medium or the operation mode of the printing apparatus.

In the above two embodiments, the CPU 200 reads data from the memory (DRAM) every time for processing of HV conversion, and when a predetermined amount of data is obtained, a rewriting operation to the memory is performed. However, when it is so constructed that DMA (direct memory access) transfer is possible between the DRAM and respective registers, and only the starting of DMA transfer is instructed by the CPU, processing speed can be made even higher.

(Others)

In inkjet printing methods, the present invention achieves distinct effect when applied to a print head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof are disclosed in U.S. Pat. Nos. 4,723,129 and 4,740,796, and it is preferable to use this basic principle to implement such a system. Although this system can be applied either to on-demand type or continuous type inkjet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces a sudden temperature rise that exceeds the nucleate boiling so as to cause film boiling on heating portions of the print head; and third, bubbles are grown in the liquid (ink) corresponding to the drive signals. By using the growth and collapse of the bubbles, the ink is expelled from at least one of the ink ejection orifices of the head to form one or more ink drops. A drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a print head, which is incorporated into the present invention: this structure includes heating portions disposed on bent portions in addition to a combination of the ejection orifices, liquid passages and the electrothermal transducers disclosed in the above patents. Moreover, the present invention can be applied to structures disclosed in Japanese Pat. Application Laid-Open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the print head, the present invention can achieve printing positively and effectively.

The present invention can be also applied to a so-called full-line type print head whose length equals the maximum length across a printing medium. Such a print head may consist of a plurality of print heads combined together, or one integrally arranged print head.

In addition, the present invention can be applied to various serial type print heads; a print head fixed to the main assembly of a printing apparatus; a conveniently replaceable chip type print head which, when loaded on the main assembly of a printing apparatus, is electrically connected to the main assembly, and is supplied with ink therefrom; and a cartridge type print head integrally including an ink reservoir.

It is further preferable to add a recovery system, or a preliminary auxiliary system for a print head as a constituent of the printing apparatus because they serve to make the effect of the present invention more reliable. Examples of the recovery system are a capping means and a cleaning means for the print head, and a pressure or suction means for the print head. Examples of the preliminary auxiliary system are a preliminary heating means utilizing electrothermal transducers or a combination of other heater elements and the electrothermal transducers, and means for carrying out preliminary ejection of ink independently of the ejection for printing. These systems are effective for reliable printing.

The number and type of print heads to be mounted on a printing apparatus can also be changed. For example, only one print head corresponding to a single color ink, or a plurality of print heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Further, the treatment liquid for insolubilizing the ink dyestuff can be obtained as follows as an example.

Specifically, after the following components are mixed together and dissolved, the mixture is pressure-filtered by using a membrane filter of 0.22 mm in pore size (tradename: Fluoropore filter manufactured by Sumitomo Electric Industries, Ltd.), and thereafter, pH of the mixture is adjusted to a level of 4.8 by adding sodium hydroxide whereby liquid A1 can be obtained.

Components of A1 low molecular weight ingredients of a cationic compound;

stearyl-trimethyl ammonium salts (tradename: Electrostriper QE, manufactured by Kao Corporation), or stearyl-trimethyl ammonium chloride (tradename: Yutamine 86P, manufactured by Kao Corporation) 2.0 parts by weight high molecular weight ingredients of a cationic compound;

copolymer of diarylamine hydrochloride and sulfur dioxide (having an average molecular weight of 5000) (tradename: polyaminesulfon PAS-92, manufactured by Nitto Boseki Co., Ltd.)

| | |
|---|---|
| | 3.0 parts by weight |
| thiodiglycol; | 10 parts by weight |
| water | balance |

Preferable examples of ink which becomes insoluble by mixing the aforementioned treatment liquid can be noted below.

Specifically, the following components are mixed together, and the resultant mixture is pressure-filtered with a membrane filter of 0.22 mm in pore size (tradename: Fluoropore filter, manufactured by Sumitomo Electric Industries, Ltd.) so that yellow ink Y1, magenta ink M1, cyan ink C1 and black ink K1 can be obtained.

Y1

| | |
|---|---|
| C. I. direct yellow 142 | 2 parts by weight |
| thiodiglycol | 10 parts by weight |
| acetynol EH (tradename:manufactured by Kawaken Fine Chemical Co., Ltd.) | 0.05 parts by weight |
| water | balance |

M1 having the same composition as that of Y1 except that the dyestuff is changed to 2.5 parts by weight of C. I. acid red 289.

C1 having the same composition as that of Y1 except that the dyestuff is changed to 2.5 parts by weight of C. I. acid blue 9.

K1 having the same composition as that of Y1 except that the dyestuff is changed to 3 parts by weight of C. I. food black 2.

Ink usable for carrying out the present invention is not limited only to dyestuff ink, and pigment ink having pigment dispersed therein can also be used. Any type of treatment liquid can be used, provided that pigment is aggregated with it. The following pigment ink can be noted as an example of pigment ink adapted to cause aggregation by mixing with the treatment liquid A1 previously discussed. As mentioned below, yellow ink Y2, magenta ink M2, cyan ink C2 and black ink K2 each containing pigment and an anionic compound can be obtained.

Black ink K2

The following materials are poured in a batch type vertical sand mill (manufactued by Aimex Co.), and glass beads each having a diameter of 1 mm are filled as media using anion based high molecular weight material P-1 (aqueous solution containing a solid ingredient of styrene. methacrylic acid ethylacrylate of 20% having an acid value of 400 and an average molecular weight of 6000, neutralizing agent: potassium hydroxide) as the dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 100 nm is produced.

(Composition of carbon black dispersing element)

| | |
|---|---|
| P-1 aqueous solution (solid ingredient of 20%) | 40 parts |
| carbon black Mogul L (tradename:manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus-obtained dispersing element is sufficiently dispersed in water, and black ink K2 containing pigment for ink jet printing is obtained. The final product has a solid ingredient of about 10%.

Yellow ink Y2

Anionic high molecular P-2 (aqueous solution containing a solid ingredient of 20% of stylene-acrylic acid methyl methaacrylate having an acid value of 280 and an average molecular weight of 11,000, neutralizing agent: diethanolamine) is used as a dispersing agent and dispersive treatment is conducted in the same manner as production of the black ink K2 whereby a yellow color dispersing element having a weight-average grain size of 103 nm is produced.

(Composition of yellow dispersing element)

| | |
|---|---|
| P-2 aqueous solution (having a solid ingredient of 20%) | 35 parts |
| C. I. pigment yellow 180 (tradename:Nobapalm yellow PH-G, manufactured by Hoechst Aktiengesellschaft Co.) | 24 parts |

-continued

| | |
|---|---|
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

Cyan ink C2

A cyan colored-dispersant element having a weight-average grain size of 120 nm is produced using anionic high molecular P-1 as a dispersing agent, and moreover, using the following materials and conducting dispersing treatment in the same manner as for the carbon black dispersing element.

(Composition of cyan colored-dispersing element)

| | |
|---|---|
| P-1 aqueous solution (having solid ingredient of 20%) | 30 parts |
| C. I. pigment blue 153 (tradename:Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

Magenta ink M2

Magenta color dispersing element having a weight-average grain size of 115 nm is produced by using the anionic high molecular P-1 used when producing the black ink K2 as a dispersing agent, and moreover, using the following materials in the same manner as that in the case of the carbon black dispersing agent.

(Composition of the Magenta Colored Dispersing Element)

| | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

According to the present invention, the aforementioned treatment liquid and ink are mixed with each other at a position on the printing medium or at a position where they penetrate in the printing medium. As a result, the ingredient having a low molecular weight or cationic oligomer among the cationic material contained in the treatment liquid and the water soluble dye used in the ink having an anionic radical are associated with each other by an ionic mutual function as a first stage of reaction whereby they are instantaneously separated from the solution liquid phase. As a result, a dispersion destruction takes place in the pigment ink, generating a pigment aggregation body.

Next, since the associated material of the dyestuff and the cationic material having a low molecular weight or cationic oligomer are adsorbed by the ingredient having a high molecular weight contained in the treatment liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of the polymer.

The term "insoluble" or "aggregation" refers to observable events in only the above first stage or in both the first and second stages.

As insolubilization or agglomeration used in the present specification, an example thereof is the phenomenon of only the above first stage; another example is a phenomenon including both the first stage and the second stage.

When the present invention is carried out, since there is no need to use cationic material having a high molecular weight or polyvalent metallic salts as in the prior art, or even though there is need of using them, it is sufficient that they are assistantly used to improve an effect of the present invention, and the quantity used can be minimized. As a result, the fact that there is no reduction of a property of color exhibition, which is a problem in achieving water resistibility when using the conventional cationic high molecular weight material and the polyvalent metallic salts, can be noted as another effect of the present invention.

With respect to a printing medium usable for carrying out the present invention, there is no specific restriction; so-called plain paper such as copying paper, bond paper or the like conventionally used can preferably be used. Of course, coated paper specially prepared for ink jet printing and OHP transparent film are preferably used. In addition, ordinary high quality paper and bright coated paper can preferably be used.

Further, the present invention can be applied to a print system as well as a printing apparatus used as an image output terminal of image data supply apparatuses such as computers, scanners, and digital cameras. A print system to which the present invention can be applied may be a print system comprising separate plural equipment (host computer, interface apparatus, scanner, printer, etc., for example) or a print system in which a plurality of apparatuses are integrated. The print system in which a plurality of apparatuses are integrated may be a copier integrated with a scanner and a printer, a facsimile machine integrated with a data transmitting/receiving apparatus and a printer, a word processor or electronic typewriter integrally having a printer, or a digital camera integrated with a printer.

As described above, according to the present invention, processing for forming data for depositing the treatment liquid for improving fixing or water resistance of ink by insolubilizing or coagulating the color material in the ink is possible by a method in which processing the image data for performing HV conversion for converting raster data into column data for image data to be printed is temporarily stored, and an HV conversion result is rewritten are performed simultaneously in the same sequence. Therefore, such data formation processing is performed at a high speed, and the processing time is reduced. By this processing, since appropriate treatment liquid ejection data formation time approaches the processing time for the case of not forming the data, high-speed printing of an image having improved fixing and water resistance is achieved. Further, it is also possible to deal with an increased number of print nozzles without decreasing the printing speed.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus using a print head on which ejection openings capable of forming print dots by ejecting inks on a printing medium are arranged, and a treatment liquid head on which ejection openings capable of forming treatment liquid dots by ejecting a treatment liquid for insolubilizing or coagulating a color material in the ink are arranged, said print head and said treatment liquid head being scanned relatively to the printing medium in a direction different from a direction of arrangement of the ejection openings, said apparatus comprising:

means for converting data continuing in a direction corresponding to the relative scanning as data for print dots to be formed on the printing medium into data in a direction corresponding to the arrangement direction of said ejection openings means for generating forming position information of the treatment liquid dots on the printing medium corresponding to the data for print dots; and control means for processing the data conversion by said converting means and the generation of the treatment liquid dot forming position information by said generating means, in a same sequence.

2. An ink jet printing apparatus as claimed in claim 1, further comprising first storage means for storing data continuing in the direction corresponding to the relative scanning, second storage means for storing data converted by said conversion means, and third storage means for storing the treatment liquid dot forming position information generated by said generating means.

3. An ink jet printing apparatus as claimed in claim 2, further comprising means for serial scanning said print head and said treatment liquid head relative to the printing medium, wherein said first storage means stores sequential data for the print dots in a raster direction, and said converting means converts the sequential data in the raster direction into data in the direction corresponding to the arrangement direction.

4. An ink jet printing apparatus as claimed in claim 3, wherein said converting means has print data storing means for temporarily holding part of the raster direction sequential data stored in said first storage means, write control means for temporarily saving a part of the raster direction sequential data read from said first storage means by writing the part into said print data storing means, and read means for controlling data read from said print data storing means to convert the temporarily saved raster direction sequential data into data in the direction corresponding to the arrangement direction, said generating means has treatment liquid data locating means for locating data related to forming position information of the treatment liquid dots on the printing medium based on data stored in said print data storing means with respect to the raster direction or the direction corresponding to arrangement of ejection openings of said treatment liquid head, and read control means for reading the located data as data in the direction corresponding to the arrangement direction, said control means has means for generating a write signal and a read signal for accessing said print data storing means of said converting means by designating a read address of the raster direction sequential data stored in said first storage means, means for sequentially making a signal for writing data converted according to said read signal into said second storage means, means for generating a signal for locating data to said treatment liquid data locating means of said generating means in relation to the access and a signal for performing data reading, and means for sequentially making a signal for writing data related to the treatment liquid generating position information in the direction corresponding to the read arrangement, and the data conversion by said converting means and the generating of the treatment liquid dot forming position information by said generating means are processed in the same sequence.

5. An ink jet printing apparatus as claimed in claim 4, wherein said first, second and third storage means are provided in a dynamic random access memory, and said control means includes means for controlling read-modify-write cycle of said dynamic random access memory, and for controlling generation and transmission of the write signal and the read signal to said print data storing means and said treatment liquid data locating means.

6. An ink jet printing apparatus as claimed in claim 4, wherein said generating means has means for temporarily holding data which is masked into a pattern corresponding to regulation of the forming position of the treatment liquid dots on the printing medium, and is related to print dots accessed by said print data storing means, as said treatment liquid data locating means.

7. An ink jet printing apparatus as claimed in claim 4, wherein said generating means has means for temporarily holding data related to print dots accessed by said converting means as said treatment liquid data locating means, and means for spreading a masking pattern according to deposition of the treatment liquid dots on the printing medium, and wherein storage processing to said third storage means is performed after processing according to the masking pattern is performed on the held data.

8. An ink jet printing apparatus as claimed in claim 7, further comprising means for making said masking pattern spreading means spread a required masking pattern prior to the data conversion by said converting means and the generation of the treatment liquid dot forming position information by said generating means.

9. An ink jet printing apparatus as claimed in claim 4, wherein a plurality of print heads are provided corresponding to inks of different color tones, said control means causes to perform conversion related to inks of the different color tones sequentially by an amount corresponding to a capacity of said print data storing means, and at completion thereof, data located in said treatment liquid data locating means is read.

10. An ink jet printing apparatus as claimed in claim 1, wherein at least said print head has an electrothermal transducer to generate thermal energy for causing film boiling in ink as energy for ejecting ink from said ejection openings.

11. An ejection data forming method for an ink jet printing apparatus using a print head on which ejection openings capable of forming print dots by ejecting inks on a printing medium are arranged, and a treatment liquid head on which ejection openings capable of forming treatment liquid dots by ejecting a treatment liquid for insolubilizing or coagulating a color material in the ink are arranged, said print head and said treatment liquid head being scanned relatively to the printing medium in a direction different from a direction of arrangement of the ejection openings, said method comprising the steps of:

converting data continuing in a direction corresponding to the relative scanning as data for print dots to be formed on the printing medium into data in a direction corresponding to the arrangement direction of said ejection openings;

generating forming position information of the treatment liquid dots on the printing medium corresponding to the data for print dots; and controlling the data conversion by said converting step and the generation of said treatment liquid dot forming position information by said generating step to be processed in a same sequence.

12. An ejection data forming method for an ink jet printing apparatus as claimed in claim 11, wherein said apparatus comprises first storage means for storing data continuing in the direction corresponding to the relative scanning, second storage means for storing data converted by said conversion step, and third storage means for storing the treatment liquid dot forming position information generated by said generating step.

13. An ejection data forming method for an ink jet printing apparatus as claimed in claim 12, wherein said apparatus comprises means for serial scanning said print head and said treatment liquid head relative to the printing medium, said first storage means stores sequential data for said print dots in a raster direction, and said converting step converts said sequential data in the raster direction into data in the direction corresponding to the arrangement direction.

14. An ejection data forming method for an ink jet printing apparatus as claimed in claim 13, wherein said converting step uses print data storing means for temporarily holding part of the raster direction sequential data stored in said first storage means, and has a write control step of temporarily saving a part of the raster direction sequential data read from said first storage means by writing the part into said print data storing means, and a read step of controlling data read from said print data storing means to convert the temporarily saved raster direction sequential data into data in the direction corresponding to the arrangement direction, said generating step uses treatment liquid data locating means for locating data related to forming position information of the treatment liquid dots on the printing medium based on data stored in said print data storing means with respect to the raster direction or the direction corresponding to arrangement of ejection openings of said treatment liquid head, and has a read control step of reading the located data as data in the direction corresponding to the arrangement direction, said controlling step has a step of generating a write signal and a read signal for accessing said print data storing means in said converting step by designating a read address of the raster direction sequential data stored in said first storage means, a step of sequentially making a signal for writing data converted according to said read signal into said second storage means, a step of generating a signal for locating data to said treatment liquid data locating means in said generating step in relation to the access and a signal for performing data reading, and a step of sequentially making a signal for writing data related to the treatment liquid generating position information in the direction corresponding to the read arrangement, and the data conversion by said converting step and said generating of the treatment liquid dot forming position information by said generating step are processed in the same sequence.

15. An ejection data forming method for an ink jet printing apparatus as claimed in claim 14, wherein said first, second and third storage means are provided in a dynamic random access memory, and said controlling step, by using means for controlling a read-modify-write cycle of said dynamic random access memory, controls generation and transmission of the write signal and the read signal to said print data storing means and said treatment liquid data locating means.

16. An ejection data forming method for an ink jet printing apparatus as claimed in claim 14, wherein said generating step uses means for temporarily holding data which is masked into a pattern corresponding to regulation of the forming position of the treatment liquid dots on the printing medium, and is related to print dots accessed by said print data storing means, as said treatment liquid data locating means.

17. An ejection data forming method for an ink jet printing apparatus as claimed in claim 14, wherein said generating step uses means for temporarily holding data related to print dots accessed by said converting step as said treatment liquid data locating means, and means for spreading a masking pattern according to deposition of the treatment liquid dots on the printing medium, and wherein storage processing to said third storage means is performed after processing according to the masking pattern is performed on the held data.

18. An ejection data forming method for an ink jet printing apparatus as claimed in claim 17, further comprising a step of making said masking pattern spreading means spread a required masking pattern prior to the data conversion by said converting step and the generation of the treatment liquid dot forming position information by said generating step.

19. An ejection data forming method for an ink jet printing apparatus as claimed in claim 14, wherein a plurality of print heads are provided corresponding to inks of different color tones, said controlling step causes to perform conversion related to inks of the different color tones sequentially by an amount corresponding to a capacity of said print data storing means, and at completion thereof, reads data located in said treatment liquid data locating means.

20. An ejection data forming method for an ink jet printing apparatus as claimed in claim 11, wherein at least said print head has an electrothermal transducer to generate thermal energy for causing film boiling in ink as energy for ejecting ink from said ejection openings.

* * * * *

UNITED STATES PATENT AND TRADEMARK OFFICE

CERTIFICATE OF CORRECTION

PATENT NO. : 6,547,358 B1
DATED : April 15, 2003
INVENTOR(S) : Tanaka et al.

It is certified that error appears in the above-identified patent and that said Letters Patent is hereby corrected as shown below:

Column 3,
Line 12, “FIG. 1:” should read -- FIG. 1; --.

Column 8,
Line 3, “timing,” should read -- timing. --.

Column 10,
Line 16, “403B.” should read -- 403B, --.
Line 37, “register” should read -- register. --.

Column 17,
Line 37, “openings” should read -- openings; --.

Signed and Sealed this

Eighteenth Day of November, 2003

JAMES E. ROGAN
*Director of the United States Patent and Trademark Office*